United States Patent [19]

Shipman

[11] 4,307,737

[45] Dec. 29, 1981

[54] HAIR BRAIDER

[76] Inventor: Paul Shipman, 3835 Ridgeley Dr., Los Angeles, Calif. 90008

[21] Appl. No.: 173,634

[22] Filed: Jul. 30, 1980

[51] Int. Cl.[3] ..... A45D 2/00

[52] U.S. Cl. ..... 132/9; 87/33; 87/25

[58] Field of Search ..... 132/9, 42 R; 87/25, 87/33, 62, 37, 38; 33/178 B

[56] References Cited

U.S. PATENT DOCUMENTS

| | | | |
|---|---|---|---|
| 2,513,451 | 7/1950 | Clark | 87/33 |
| 2,717,528 | 9/1955 | Swackhamer | 87/33 |
| 3,209,463 | 10/1965 | Schorr | 33/178 B |
| 4,038,966 | 8/1977 | Eronini et al. | 132/9 |

FOREIGN PATENT DOCUMENTS

| | | | |
|---|---|---|---|
| 927309 | 10/1947 | France | 132/42 R |
| 389180 | 6/1965 | Sweden | 132/42 R |

*Primary Examiner*—Gene Mancene

*Assistant Examiner*—John J. Wilson

*Attorney, Agent, or Firm*—Howard L. Johnson

[57] ABSTRACT

Cylindrical open-top container houses generally annular slide track having diametric unidirectional stretch, the tracks being bordered by laterally extending guide rails which engage restricted necks of a row of individual holders which are each slidable along the track. Each holder supports a removable, outward-projecting hair tube, having a tensioning plug to yieldably retain a cluster of hair inserted therein. A pair of centrally pattern-apertured guide disks surround the outer edge of the track and are shiftable in unison 180° in either direction so as to move successive holders from exit position of stretch to entry position at opposite end thereof, the shift being manually directed (by radially projecting lever) alternately clockwise and counterclockwise along the annular track so as thereby to braid together clusters of hair as they extend progressively from the respective trio of tubes thus carried by the slidable holders.

6 Claims, 16 Drawing Figures

HAIR BRAIDER

This invention is shown in Disclosure Document No. 076845 filed in the U.S. Patent Office Jan. 2, 1979 by the present inventor.

BACKGROUND

A popular hair style for those having long hair is to form it into a plurality of braids, each consisting of three composite strands of hair interlaced or positioned lengthwise to its free end so that the completed braid extends from a starting position near the scalp to the end of the hair where it may be held against unraveling as by a clip. The individual braid may then have a ribbon, beads, or other decoration attached to it and/or may be twisted together with other braids into a compact configuration which is secured atop the scalp as by hairpins, hairspray and the like.

From time to time the composite coiffure may be taken down (without unbraiding) as for washing the hair or scalp or changing the decorative attachments; the braids are then reassembled to form the same or a different patten. However in time the continuously growing hair produces a considerable, unbraided length extending from the scalp to the start of braiding. This may make it more difficult to anchor the previously formed pattern of braids. Eventually, all the braids are taken apart and a new series is formed, starting nearer the scalp.

Usually such braid formation is performed by a person other than the one who is obtaining the coiffure, and essentially this is very time-consuming, requiring a number of hours and even extending over a couple of days. This is tedious, both for the hair stylist and for the customer whose head is being worked over. It also requires some acquired skill on the part of the worker, so the total cost may be considerable.

Accordingly, the present invention provides a hand-held device by which the worker can form successive braids of a person's scalp-attached hair, with uniformity and at a very considerable saving of time. Also, such device can be operated by an unskilled worker so that members of a family, for example, can use it to braid each other's hair at home.

BRIEF SUMMARY OF THE INVENTION

The invention provides a plurality (e.g. three) separate, telescopic-extensible, hair tubes in each of which a cluster of hair, by manual use of a puller element, is placed lengthwise and yieldably held by tensioning means (i.e. a removable plug, spring-urged in arcuate contact with the hair inside the tube). The upright-standing hair tubes are individually latched into a corresponding number of open-top holders which are individually longitudinally axially-pivotal and laterally slidable along a pair of closed tracks or slideways of a hand-holdable container, the holders being individually retained in the container body by means of lower, restricted neck segments which are engaged by laterally projecting guide rails or lugs which follow the course of the slide track.

The slide track is formed by two closed loops having a central (unidirectional) stretch which is common to both. This central stretch has a length which will accommodate in a single file or row, one more than the number of slidable holders (i.e. a stretch capable of holding a line of four upstanding holders when there are a total of three in the system). One leading or forward end of this unidirectional stretch forms the exit position; the opposite end is the entry position. After arrival of a holder at entry position, behind two holders centered midway in the stretch, the line of three holders is then moved (pushed) in unison, one space along the central stretch, so as now to bring the foremost holder to the exit position (and leave the entry position vacant). By itself, it can then be moved along either selected loop, 180° clockwise or counterclockwise, to the vacant entry position. This is done by the operator activating the following mechanism:

Fixedly centered within the container is an upwardly bifurcate post, the two arms of which are outwardly arcuate, with opposing parallel faces spaced apart to define a transverse slideway dimensioned to contain two slide holders, that is, it is half the length of the central stretch just described, forming the midportion thereof. Rotatably surrounding the post, intermediate its height, are a pair of identical disks formed with the same cut-out guide patterns which define the perimeters of the two closed-loop paths which are joined by the central stretch. The pair of disks are fastened together within the container by an upright support from which a manual operating handle projects radially outward through an arcuate slot of the cylindrical container. A holder which is located at the exit position of the central stretch will thus be held at the corresponding end of the cut-out of the two guide disks. Movement of the coupled disks (by the projecting handle) in one direction or the other, that is, clockwise or counterclockwise, will carry the "captured" holder (with its hair tube) from the exit position to the entry position. Movement of successive holders in alternate half circles (180°) will cause the corresponding hair clusters to interlace or form braids.

To insure that the space at the entry position of the central stretch of the slideway is normally vacant, there is a pair of similar, U-shaped pusher rods, each having a central chordal segment receivable in arcuate slots of the container cylinder (opposite the slot holding the operating handle) in position to engage the side of a slide holder (arriving) at the entry position and, by action of container-embracing bands of tension springs connected to respective U-arms, slide the newly-arrived holder (and the line of preceding holders in the central stretch) ahead by one space. This restores a vacancy to the entry position and brings another holder to the exit position from which it can be moved by the manually operating handle. Such handle and mechanism can be moved fairly rapidly while the container is moved lengthwise to the forming braid, as permitted by the tensioning plugs in each hair tube yielding as the container is drawn down.

DETAILED DESCRIPTION

Figure 2:
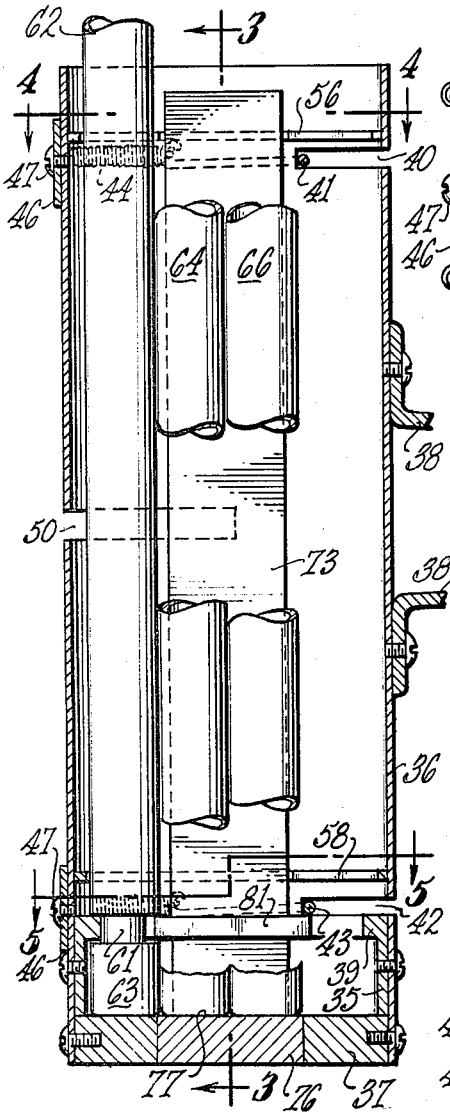
FIG. 2 is a vertical sectional view through the container with the trio of slidable holders retained therein, shown partly broken away and in elevation.

The present braiding device is exemplified by a relatively small, hand held and manipulated assembly which one person can use to form braids of the natural hair of manipulatable length as it is still growing from (or attached to) the owner's head. Of course an artificial hairpiece can be braided in the same way, as long as it is fastened at one end. Likewise flexible filaments other than hair can be similarly braided as long as a free end is adjacent the assembly; other filament examples include artificial and natural fiber, thread, wire, cord, etc. For simplicity, the filament is herein usually called "hair". Likewise, four or more clusters of filaments can be similarly interlaced by such device which has a corresponding number of filament tubes and holders.

As here illustrated, there are a plurality of elongated, filament attachment units, typically longitudinal support channels or open-ended tubes 10 (FIGS. 7–8), here three in number and designated A, B, C in FIGS. 10–14, each adapted to have a cluster of hair disposed along its length. When using a cylindrical tube, near its top there is a cut out window 12 extending for a short length down its side so as to allow insertion and removal of a tensioning plug 14 (FIG. 9) which may be held with an arcuate contact face 15 in engagement with correspondingly spread hair. The plug is yieldingly held by opposing pivot arms 16, 17 of an outward embracing clasp 18 which dependently is secured to a coil spring 20, the latter attached to the tube 10 by a screw 21.

A lower, projecting length 11 of the tube is circumferentially diminished to form a telescopic extension or liner which dependently is received in a separate tube length 22 having an anchorage screw 23 for holding it at the desired amount of extension. The lower tube 22 also has a projecting stud 24 for coupling the composite tube 10/22 in a holder as subsequently described. The several hair tubes are interchangeable and thus insertable and removable in open-top holders so as to extend outward generally parallel to the extending lengths of filaments (and resulting braid).

Figure 7:
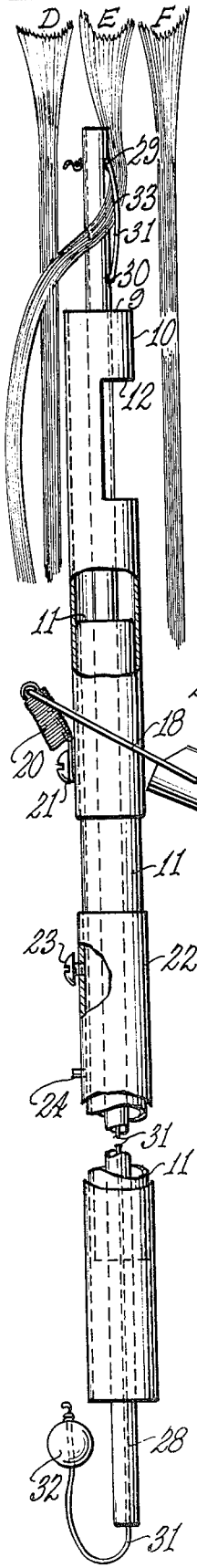
FIG. 7 is an elevational view of a trio of prebraided, hair clusters and a separate hair tube, with a hair puller rod inserted up lengthwise therethrough with the upper loop portion engaging a cluster of hair in position to be pulled down through the tube.
Figure 8:
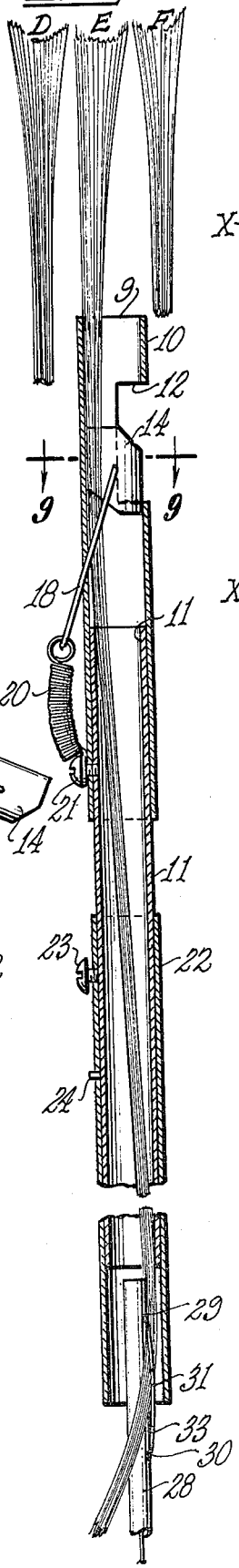
FIG. 8 is similar to FIG. 7 but with the hair tube shown in axial section, with the engaged hair cluster pulled through and the hair puller seen emerging from the lower end.
Figure 10:
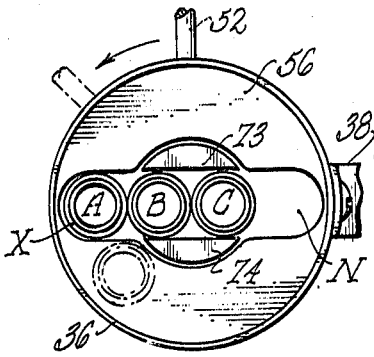
FIGS. 10–14 are semi-schematic plan views of the trio of hair tubes—designated A, B, C—in successive shift positions as moved about within the container by the guide disks.
Figure 11:
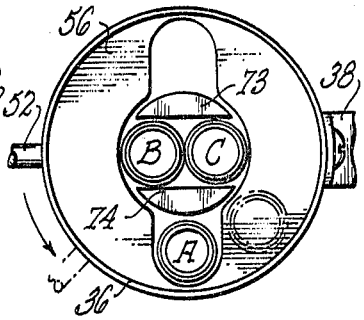
Figure 9:
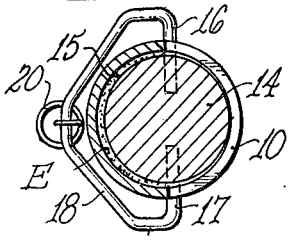
FIG. 9 is a transverse section along line 9—9 of FIG. 8, particularly showing the spring-urged hair tensioning plug in the tube.
Figure 14:
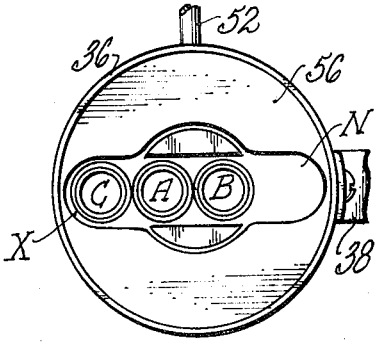
Figure 16:
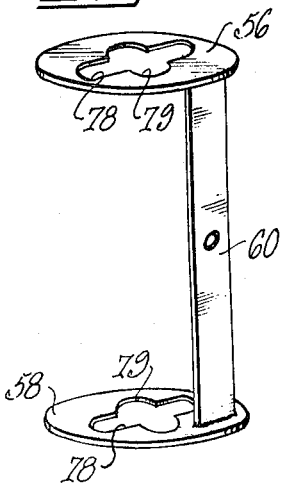
FIG. 16 is a perspective view of the pair of identical guide disks with cut-out patterns defining the alternate slide paths, held together by the upright support, all of which are normally located rotatable within the housing container.
Figure 15:
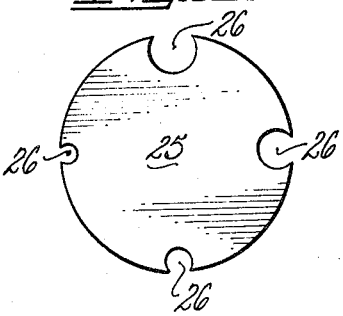
FIG. 15 is a face view of a disk-shaped hair gauge having several edge recesses, each of a different size or capacity, in any of which clusters of hair may be inserted in order to measure or separate successive clusters having approximately the same number (or composite thickness) of strands for a desired braid.

As seen in FIGS. 7–8, a length of hair may be manually divided into three clusters D, E, F, as measured by edge sockets 26 of the gauge 25 (FIG. 15), or it may merely be separated in response to visual measurement. To get such a length placed into a tube 10, there is provided a puller unit (FIG. 7–8) comprising a thin tube 28 having two side holes 29, 30 spaced apart lengthwise from its upper end, and a cord 31 threaded respectively out and in through the successive holes to form an outside loop segment 33. The cord is then led down the interior of the tube and out the bottom end to a terminal attachment tab 32.

Such puller tube 28 may be inserted upward through the length of the hair tube 10 until the loose segment 33 is above the top of the tube 10 (the plug 14 being disposed outside as shown in FIG. 7) and a cluster of hair E is then lodged between the cord 33 and the puller tube 28; with the cord drawn taut, the puller is drawn out of the hair tube 10, thus threading the hair cluster E through its length. With the top edge 9 then held fairly close to the scalp, the spring-loaded tensioning plug 14 is replaced in its initially loose "socket", now pressing the outspread hair strands against the internal wall of the tube 10. After all three of the hair tubes are thus attached to separate clusters, as the latter are interlaced or braided, the device itself is progressively drawn lengthwise down the grasped clusters to their end; the hanging weight of the device keeps taut the yet unbraided, short lengths of hair which are immediately above the tops of the several tubes.

A housing is formed by a generally cylindrical, open-top container 36 having a flat bottom 37 for ease of standing upright when not in use, and a laterally projecting handle 38. Near the top and bottom margins respectively, parallel arcuate (horizontal) slots 40, 42 are formed, each loosely lodging the chordal segment 41, 43 (FIG. 4) of a U-shaped rod. The respective arms 48, 49 of each U are externally tensioned by a composite spring assembly which outwardly embraces the container and is formed by a pair of tension springs 44, 45 coupled to a central, bowed plate or link 46 (having a desired curvature of greater radius than that of the container 36) which is pivoted to the container wall by a central stud or screw 47. Along the opposite semi-circular face of the container 36 is a third or mid-height arcuate slot 50 from which a shift lever or operating rod 52 projects as will be explained.

Figure 3:
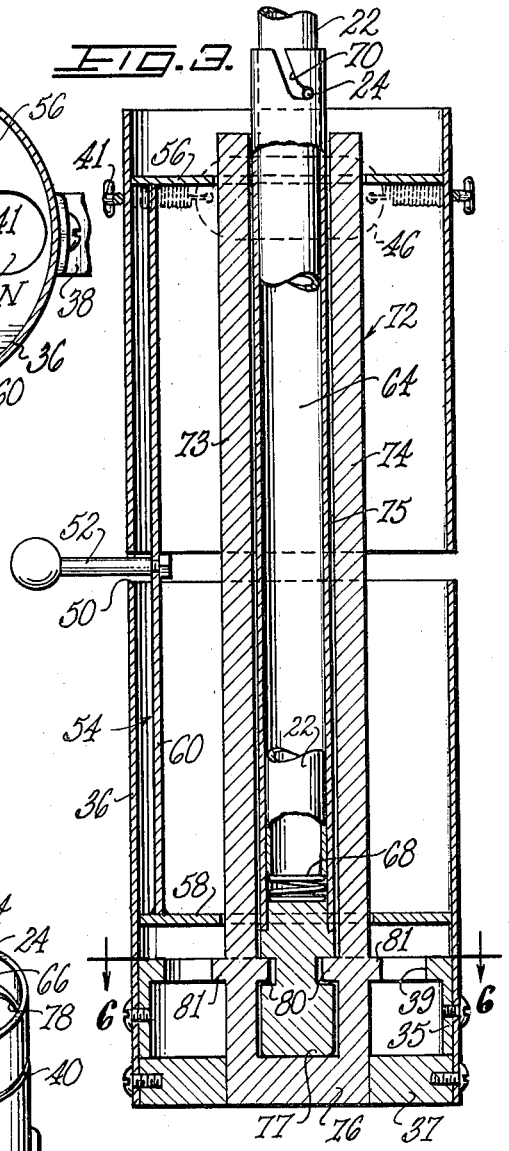
FIG. 3 is a vertical section taken along the line 3—3 of FIG. 2 of the container, showing the central guide or channel post with a holder located therein and a hair tube latched into the holder.
Figure 1:
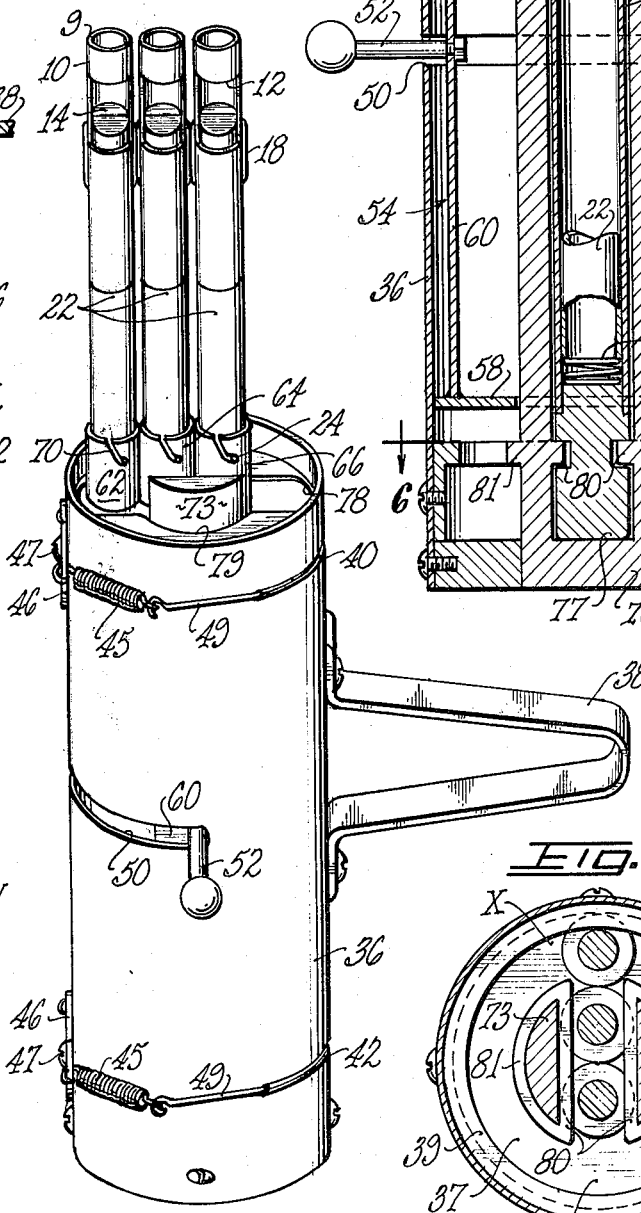
FIG. 1 is a perspective view of the assembled hair braider viewed from above.

Within the container 36 is an arcuately reciprocable shift unit 54, formed by upper 56 and lower 58 annular guide disks, fixedly connected to each other by an upright support member 60 from which the operating lever 52 projects outward through the slot 50. Upright positioned within aligned apertures of the guide disks 56, 58 are a number of open-top holder tubes 62, 64, 66, corresponding in number to the number of hair tubes 10, (i.e. three). Each holder tube has a compression spring 68 located adjacent the bottom of its cavity, and its upper edge is formed with a locking slot 70 (FIG. 3) placed to latch the positioning stud 24 of each hair tube 10/22 which is moved beneath it.

Beneath the cavity bottom or floor of each holder 62, 64, 66 is a circumferentially restricted, annular neck 61 located above a cylindrical base 63 whose flat underface is atop the slidefloor 77. An annulus forms an upward peripheral extension 35 of the base 37 with an inward directed shoulder or guide rib 39 which slidingly engages the neck 61 of the several holders along the guideways and also serves to retain them within the container 36 should the latter be inverted. It will be seen also that each holder 62, 64, 66 (with its spring-held hair tube 10/22) is by this neck 61 engagement free to pivot on its longitudinal axis, thereby accommodating to untwisting movements of the cluster of hair held in an individual tube 10/22. A central or inner, annular guide rib 81 similarly slidingly engages the opposite side of each holder neck 61 so as between the two guide ribs 39, 81 to define an outer, generally circular path or slideway.

Centrally located within the housing shell 36 and surrounded by the movable pair of disks 56, 58 is an upstanding, bifurcate channel member 72, formed by a pair of outwardly arcuate arms 73, 74 which between their inner, parallel faces define a horizontal cross channel 75, rising from a cylindrical base 76 which is fixed to the bottom plate 37. The width of the channel 75 is a little more than the diameter of a holder tube 62, 64, 66 so that a row of successive, upstanding tubes can pass freely along the length of such cross channel, always in the same direction as urged by the pair of cross rods 41, 43. An extended length of this cross channel is defined by a cut-out guideway 78 formed in each guide disk 56, 58, which guideway extends a linear length which can contain four upstanding holder tubes such as 62. Medially the cut-out is arcuately widened at 79 so as to outwardly border the arcuate outer faces of the guide arms 73, 74.

Figure 4:
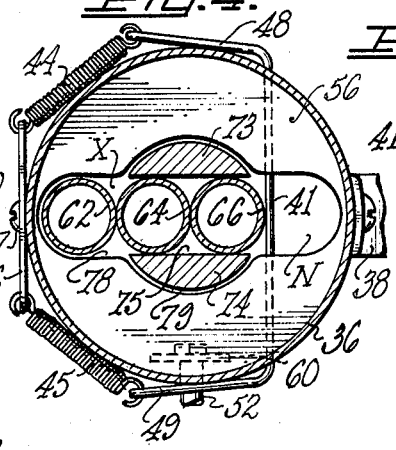
FIG. 4 is a transverse section along line 4—4 of FIG. 2.
Figure 5:
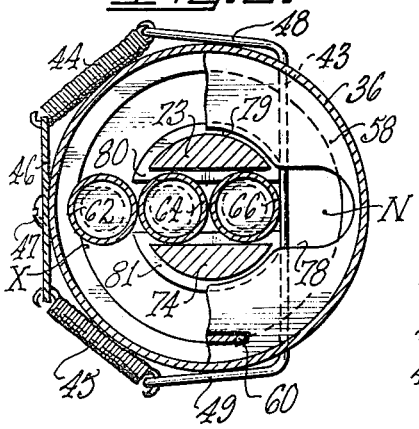
FIG. 5 is a staggered transverse section on line 5—5 of FIG. 2.
Figure 6:
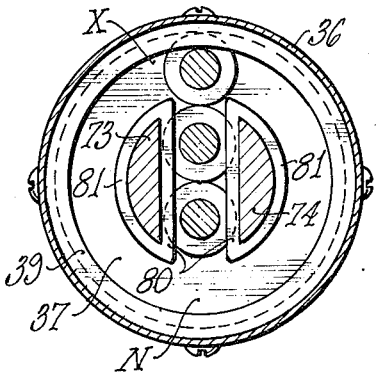
FIG. 6 is a transverse section along line 6—6 of FIG. 3.
Figure 12:
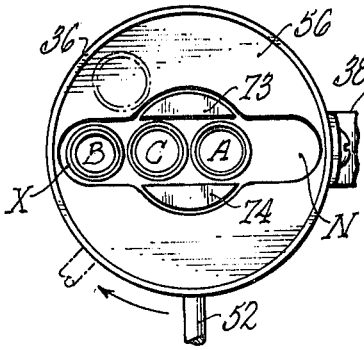
Figure 13:
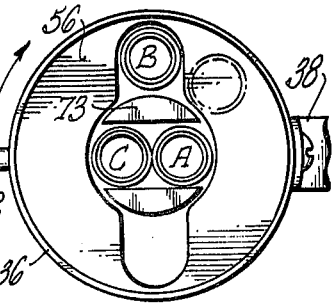

The starting or rest position of the braider assembly is shown in FIGS. 2, 4, 5, with a holder 62 located at the exit position X of the cross channel 78 of the guide disks 56, 58, with the two other holders 64, 66 located in the channel 75 of the central guide post, all three forming a continuous row or single file. By 180° counterclockwise swing of the handle 52, the leading holder 62 or A (carrying its hair tube 10) by movement of the pair of guide disks 56, 58 is carried a half turn around the post arm 74 to the entry position N of the cross channel (FIG. 12). From this position, the chordal rods 41, 43, by action of their springs 44, 45, push the newly formed row of holders B, C, A forward "one space", bringing B to the exit position X as seen in FIG. 12. Next, 180° "reverse" swing of the handle 52 (clockwise) carries B around the other arm 73 to the entry position N from which the rods 41, 43 again push the row forward to the position shown in FIG. 14. This pattern of successive swings of the handle in alternate directions is repeated until the length of the hair clusters D, E, F has been braided together and has moved up out of the tubes 10 (by progressive drawing of the container 36 away from the scalp).

I claim:

1. An assembly for braiding together lengths of filaments, said assembly comprising in combination:

a housing containing a longitudinal bifurcate post comprising a pair of laterally separated arms forming a transverse slide channel therebetween, track and guide means defining a composite path of which said slide channel forms a common stretch, said path consisting therebeyond of a pair of oppositely directed, closed loops each extending in a different direction from an exit position of the stretch back to an entry position at the opposite end thereof, a group of filament holders, individually movable along said path and movable in single file along said stretch, which stretch has space for containing in a row one holder more than the total number of said group of holders, means responsive to movement of a holder to the entry position of said stretch from either of said loops, when the remaining holders of said group are in single file along the stretch immediately ahead thereof, for moving the whole group of holders along the stretch, thereby locating a forward holder of the group at the exit position and vacating the entry position of the stretch, and shift means for selectively moving successive holders from said exit position along alternate loops of said path to the entry position, thereby braiding together the several filaments extending from respective holders.

2. An assembly according to claim 1 wherein said holders are individually lengthwise extensible so as to accommodate different lengths of filaments disposed therealong.

3. An assembly according to claim 1 wherein said track and guide means include a pair of transverse guide disks spaced apart lengthwise to the post and housing and connected together for joint reciprocable movement, selectively clockwise and counterclockwise thereabout, each of said disks being formed with a similar cut-out pattern coextensive with the length of said common stretch and joined at each end to said pair of closed loops, whereby a holder held within the cut-out pattern of said disks at the exit position of said stretch, may by joint movement of the disks be moved selectively along either one of said loops to the entry position of the stretch.

4. An assembly according to claim 3 wherein said track and guide means include a laterally extending guide shoulder and a corresponding slideway for engaging the same, one carried by individual holders and the other disposed along said composite path of the housing.

5. An assembly according to claim 1 wherein said holders comprise open-ended tubes which are formed with a lateral opening near the top thereof, and include a tensioning plug having an arcuate contact face, which plug is selectively insertable within said opening and has resilient means for holding said contact face in yielding engagement with said filaments within the tube.

6. An assembly for braiding selected clusters of similar length filaments such as hair, while the filaments are held at one end thereof and the braid formed thereby is progressively extended toward a free end of the filaments transiently held by the assembly, said assembly comprising in combination:

at least three open-top tubes each adapted to yieldingly retain a cluster of said filaments extending thereinto from said one end, a housing having a group of individually slidable holders disposed therein, each adapted for holding one of said tubes, slide track and guide means for said holders located within the housing and defining a composite path formed by a pair of oppositely directed, closed loops having a common stretch, each loop extending in a different direction from an exit position of the stretch back to an entry position at the opposite end thereof, said stretch having space for holding in single file one holder more than the total number of said group of holders, said slide track and guide means including a central, upwardly bifurcate, fixed post having a pair of upstanding, outwardly arcuate arms, laterally spaced apart to form a slide channel for said holders therebetween, which channel forms an intermediate portion of said common stretch of the composite path, said composite path having a laterally extending guide shoulder and a corresponding slideway for engaging the same, one carried by individual holders and the other disposed along said composite path, said holders being individually pivotal along an upstanding axis so as to accommodate twisting and untwisting of a filament cluster held therein, and a pair of transverse guide disks spaced apart within the housing lengthwise to the post and connected together for joint reciprocable movement, selectively clockwise and counterclockwise about the post, each of said disks being formed with a similar cut-out pattern coextensive with the length of said common stretch and laterally bulged intermediate its ends conforming to the outer curvature of said arms, means responsive to movement of a holder to the entry position of said stretch from either of said loops, when the remaining holders of said group are in single file along the stretch immediate ahead thereof, for moving the whole group of holders along the stretch, thereby locating a forward holder of the group at the exit position and vacating the entry position of the stretch, and shift means for selectively moving successive holders from said exit position along alternate loops of said path to the entry position by reciprocable movement of said guide disks within the cut-out patterns of which said group of holders are retained, thereby braiding together the several clusters of filaments extending from the tubes which are carried by the holders.

* * * * *

UNITED STATES PATENT OFFICE

CERTIFICATE OF CORRECTION

Patent No. 4,307,737 Dated December 29, 1981

Inventor(s) Paul Shipman

It is certified that error appears in the above-identified patent and that said Letters Patent are hereby corrected as shown below:

The inventor' address [76] should read
449 Apple Grove Lane, Santa Barbara, Calif. 93105

Signed and Sealed this

Sixth Day of April 1982

[SEAL]

Attest:

GERALD J. MOSSINGHOFF

Attesting Officer

Commissioner of Patents and Trademarks